US005494112A

United States Patent [19]

Arvidson et al.

[11] Patent Number: 5,494,112

[45] Date of Patent: Feb. 27, 1996

[54] SYSTEM FOR INTRODUCTION OF CONCENTRATED LIQUID CHEMICAL FOAMANT INTO A WATER STREAM FOR FIGHTING FIRES

[75] Inventors: Lawrence C. Arvidson, New Brighton; Robert S. Horeck, Fridley, both of Minn.

[73] Assignee: Hypro Corporation, St. Paul, Minn.

[21] Appl. No.: 142,949

[22] Filed: Oct. 29, 1993

[51] Int. Cl.[6] ..... A62C 31/00

[52] U.S. Cl. ..... 169/13; 169/14; 137/101.21; 222/63; 222/135; 222/255; 222/265; 417/5; 417/46

[58] Field of Search ..... 169/13, 14, 15; 222/63, 135, 255, 265; 137/101.19, 101.21; 417/4, 5, 46, 216

[56] References Cited

U.S. PATENT DOCUMENTS 4,259,038 3/1981 Jorgensen et al. ..... 417/5 X
4,899,825 2/1990 Bosoni et al. ..... 169/14
5,174,383 12/1992 Haugen et al. ..... 169/15
5,218,988 6/1993 McNamara et al. ..... 137/101.21

*Primary Examiner*—Andrew C. Pike
*Attorney, Agent, or Firm*—Haugen and Nikolai

[57] ABSTRACT

A fire fighting system introduces a liquid chemical foam concentrate into a water stream. The system may incorporate either or both of a hydraulic motor driven pump under control of a microprocessor-based hydraulic valve driver and an electric motor driven pump under control of a DC motor drive circuit. The DC motor drive circuit is adapted to be connected in electrical communication with the hydraulic valve driver and with a display/controller also incorporating a microprocessor. When operating in the dual mode, when the quantity of chemical foamant that must be added to the water stream to maintain a desired percentage mixture exceeds the capacity of the electric motor driven foam pump, control is transferred, via the hydraulic valve driver, to allow a hydraulic motor to drive a separate foam pump. In this fashion, the electric motor driven foam pump can cover a first range of flow rates from a very low rate to an intermediate rate and the hydraulic system then taking over to extend the range from the intermediate flow rate to a relatively high flow rate.

13 Claims, 3 Drawing Sheets

SYSTEM FOR INTRODUCTION OF CONCENTRATED LIQUID CHEMICAL FOAMANT INTO A WATER STREAM FOR FIGHTING FIRES

BACKGROUND OF THE INVENTION

I. Field of the Invention

This invention relates generally to fire-fighting equipment, and more particularly to a system for accurately controlling the introduction of a liquid chemical foamant concentrate into a water stream so as to maintain a predetermined concentration of the foamant over a wide range of water flow rates.

II. Discussion of the Prior Art

In the Haugen et al. U.S. Pat. No. 5,174,383, assigned to assignee, hereof, there is described an apparatus and method for controlling the introduction of a liquid chemical foamant concentrate into a water stream for enhancing the properties of the stream in fighting certain types of fires. In that system, water from a municipal supply or from a vehicle-carried tank is pumped through a hose and directed out of a nozzle unto the fire. The nozzle will typically have a variable orifice for controlling the flow rate. A flow meter is disposed in the water line supplying the hose and produces an electrical signal proportional to the rate of water flow through the hose. The chemical foamant concentrate is contained wit:bin a supply tank and a positive displacement piston pump having an adjustable piston stroke volume is arranged to be driven by a variable speed electric motor for pumping the foamant concentrate from the supply tank into the water stream. A microprocessor-based controller receives the electrical signal from the flow meter and another signal proportional to pump speed. It computes the rate at which the electric motor driving the pump must be driven to introduce a quantity of chemical foamant concentrate into the hose so as to maintain a pre-established percentage concentration of foamant in the water stream regardless of variations in water flow rates.

While the system described in the aforereferenced Haugen et al. Patent works well, it requires a special type of pump. The range of water flow rates over which the desired foam concentration can be maintained is somewhat limited.

The Arvidson et al. U.S. Pat. No. 5,232,052 entitled "APPARATUS AND METHOD FOR CONTROLLING THE INTRODUCTION OF CHEMICAL FOAMANT INTO A WATER STREAM IN FIRE-FIGHTING EQUIPMENT" describes a system which substantially increases the range over which the foam delivery pump can be operated in maintaining a relatively constant foam/water mixture concentration. In accordance with that invention, a DC motor is used to drive the pump and the speed of the motor is controlled over a first predetermined range using pulse width modulation of the DC motor drive current. The pump speed is a function of the duty cycle of the modulating waveform. It can be made to vary between a 100% duty cycle at which the motor is driven at its full rate of speed and about a 30% duty cycle at which the pump tends to stall. To achieve pump speeds below that which can be realized with the 30% duty cycle, the pulse width modulated signal may be further burst width modulated. Here, the pulse width modulated signal is turned on and off at predetermined time intervals determined by a microprocessor-based controller. Thus, the pump drive motor is intermittently driven in a stepped mode. In this fashion, the system is capable of injecting liquid chemical foamant measured in ounces per minute up to about 2.5 gallons per minute when the DC motor driving the pump is operating at its 100% duty cycle.

A need still exists for a system that can extend the range of foam concentrate delivery upward from what can be achieved using the system of the aforereferenced Arvidson et al. patent. For example, a municipal type fire truck used in fighting building fires will typically have a water cannon for delivering large volumes of foamed water onto the fire until it is substantially extinguished and then the fire-fighting personnel may have to use hand lines requiring relatively low flow for mop-up work. A water cannon may typically deliver 1000 gallons-per-minute while the hand lines involve water flow in the 50–100 gallon-per-minute range. Given that so-called Class A foams used in fighting building-type fires should be mixed with water so as to produce about a 1% solution of foam and water, the foam injection system must typically allow for foam concentrate injection rates from as low as 0.5 gallons per minute to as high as 10 gallons per minute.

SUMMARY OF THE INVENTION

It is accordingly a principal purpose of the present invention to provide a foam injection system operable over an extended range of water flow rates encountered in fighting raging building fires and in later dousing hot spots after the major fire has been suppressed or extinguished.

Another object of the invention is to provide a control system for one or more motor driven pumps where one of the pumps is dedicated to injecting liquid chemical foam concentrate into a water stream over a first range of water flow rates and where a second pump is provided to inject the liquid chemical foamant into the water stream over a second and higher range of water flow rates.

The foregoing objects and advantages of the invention are achieved by providing a fire extinguishing system of the type including means for injecting metered quantities of liquid chemical foamant concentrate into a hose assembly conveying a water stream so as to maintain a desired concentration of the foamant concentrate in the water stream exiting the hose over a wide range of water flow rates that comprises a tank for holding a quantity of the liquid chemical foamant concentrate and first and second foam pumps, each having an inlet port and an outlet port where the inlet port of each pump is coupled to the supply tank and the outlet ports are coupled to the hose assembly. Associated with each of the foam pumps is a motor for driving those pumps. A control means responsive to a characteristic of the water flowing through the hose assembly drives the motor for the first pump when the volume rate of flow of the chemical foamant to be added to the water stream to maintain a desired concentration is below a first threshold. This control means also is configured to operate the motor associated with the second pump when the rate of flow of chemical foamant to the water stream to maintain the desired concentration is above that threshold. In accordance with one embodiment of the invention, the motor driving the first pump may be a DC variable speed motor adapted to be controlled in accordance with the aforereferenced Arvidson et al. patent while the second pump is arranged to be driven by a hydraulic motor. The first and second pumps may each be a positive displacement plunger pump or the pump driven by the hydraulic motor may be a gear pump.

The control system includes a first microprocessor which receives as its input an electrical signal proportional to a characteristic of the water flowing such as its volume rate of flow in the main water line as well as signals relating to either the speed at which the foam pump is operating or a signal related to the rate of flow of chemical foamant in the pump's output line. These signals are operands used by the computer in determining the amount of liquid chemical foamant that must be introduced into the water line to maintain a preset ratio or percentage. The computer then outputs a control signal to a pump driver circuit which is configured to operate one or the other of the two pumps, the choice depending upon the amount of chemical foamant flow required to maintain the desired concentration.

DESCRIPTION OF THE DRAWINGS

The foregoing features, objects, and advantages of the invention will become apparent to those skilled in the art from the following detailed description of a preferred embodiment, especially when considered in conjunction with the accompanying drawings in which like numerals in the several views refer to corresponding parts.

DESCRIPTION OF THE PREFERRED EMBODIMENT

Figure 1:
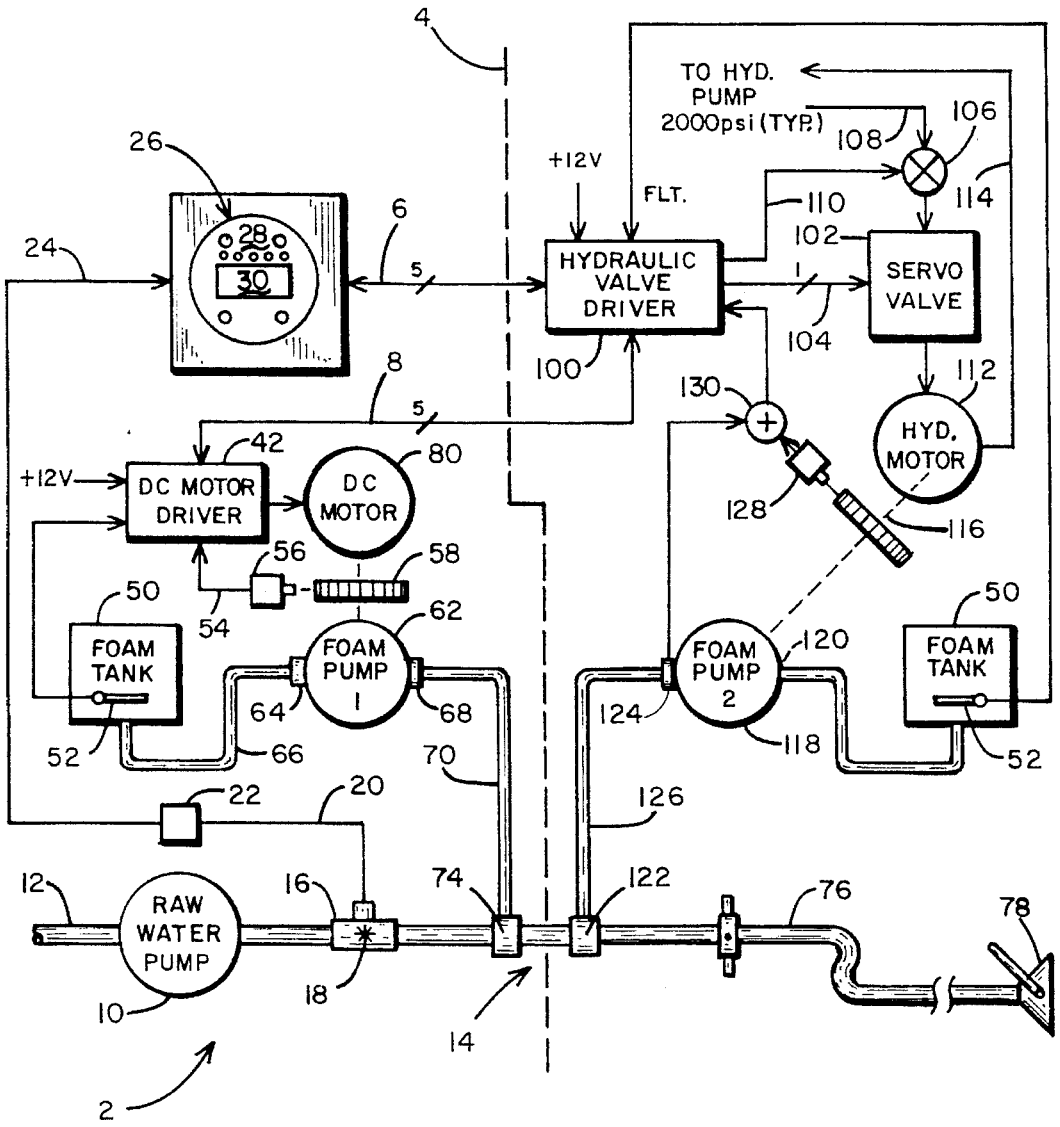
FIG. 1 is a block diagram of the foam injecting system configured in accordance with the present invention.

Referring to FIG. 1, there is indicated generally by numeral 2 a dual port foam injection system constructed in accordance with the present invention. The portion of the system lying to the left of the dashed line 4 is identical in all respects to the system described in the aforereferenced Arvidson et al. patent, the content of which is hereby incorporated by reference as if set forth in full. To ease the readability of the present application, the same reference numerals are employed to identify the components of the earlier system shown to the left of the dashed line 4. Specifically, the following components and their associated reference numerals as well as their interconnections and operating mode are set out in full in the Arvidson et al U.S. Pat. No. 5,232,052.

| Ref. No. | Component |
|---|---|
| 10 | raw water pump |
| 12 | raw water supply pipe |
| 14 | manifold |
| 16 | manifold fitting |
| 18 | sensor |
| 20, 24, 54 | conductors |
| 22 | pulse former circuit |
| 26 | display module |
| 28 | face plate |
| 30 | display panel |
| 50 | foam tank |
| 52 | float sensor |
| 56, 58 | speed sensor |
| 62 | foam pump |
| 64 | pump inlet |
| 66, 70, 76 | hose |
| 68 | pump outlet |
| 74 | injector |
| 78 | nozzle |
| 80 | DC motor |

In implementing the system of the present invention, the elements or components residing to the right of the dashed line 4 have been added and the construction and mode of operation of those components will be set forth in full herein, as will the manner in which that additional circuitry cooperates with the portion of the system disposed to the left of the dashed line 4.

With continued reference to FIG. 1, a five conductor cable 6 electrically couples the processor/display module 26 to a hydraulic valve driver circuit 100 and a further five-conductor cable 8 connects that hydraulic valve driver 100 to the DC motor driver 42. The hydraulic valve driver 100 is connected in a controlling relation to a hydraulic servo valve 102 by means of a conductor 104. The servo valve is connected to a source of high pressure hydraulic fluid by way of a shut-off valve 106 disposed in a hydraulic line 108. The shut-off valve 106 will be controlled by an on/off signal emanating from the hydraulic valve driver 100 via conductor 110.

The servo valve 102 is preferably an analog valve having an internal pilot valve that is responsive to relatively low current amplitudes and which is configured so that displacement of the pilot spool valve relative to a first very small orifice permits pressured hydraulic fluid to enter and to act on a larger area main piston. As the main piston moves, it opens yet another smaller valve acting in opposition to the pilot spool valve, allowing it to move until a balance is established in the flow on the two sides of the pilot spool valve. In this fashion, a small current can be used to control the flow of the pressurized hydraulic fluid through the servo valve 102 to a hydraulic motor 112. A servo valve suitable for use in the present invention is commercially available through Sunstrand Corporation and is identified by its Model No. MCV 113. The hydraulic fluid, of course, drives the motor at a speed determined by the servo valve 102 and the return line 114 returns the hydraulic fluid to an oil cooler and then to a reservoir associated with the system's hydraulic pump (not shown). That valve is particularly adaptable to the present invention in that it can be bolted directly to the hydraulic motor 112, thereby eliminating the need for a lot of internal plumbing.

The hydraulic motor 112 may be an axial piston style pump and its shaft 116 is represented by a dashed line. It can be seen that the shaft is connected in driving relation to a foam pump 118 which is different from the foam pump 62 associated with the DC motor driver 42. The foam pump 118, like the foam pump 62, has its inlet 120 connected to the foam tank 50 and its outlet connected to an injector 122 plumbed into the manifold 12 to which the fire hose 76 connects.

Depending upon the type of pump employed at 118 one or the other of two sensors may be used to ultimate provide the display controller 26 with information concerning the rate at which the foam pump 118 is operating. If foam pump 118 is a positive displacement pump, the same type of toothed wheel and pickup used with the DC motor 80 may be used. However, if the foam pump 118 is a non-positive displacement type pump, such as a gear pump, it is necessary to incorporate a flow meter, as at 124, in the output line 126 of the foam pump 118. Either a pickup transducer 128 or the flow meter 124 provides the necessary feedback information via OR circuit 130 to the interface circuitry in the hydraulic valve driver 100 and, as will be later explained, that feedback is ultimately sent over the five conductor cable 6 to the display controller module 26.

For convenience in the drawing of FIG. 1, the foam tank 50 is shown as two separate tanks., one being coupled to the foam pump 62 and the other being coupled to the foam pump 118. In actual practice, only a single foam tank is used, but; by showing it in two parts in FIG. 1, the need for multiple cross-overs of the plumbing and electrical lines associated with it is obviated. The float 52 in the tank is, however, preferably coupled to both the hydraulic valve driver 100 and to the DC motor driver 42 thereby provide information to both as to whether there is liquid chemical foamant concentrate in the tank available for injection into the main water stream going through the manifold 12.

The system of the present invention is capable of running in an all hydraulic mode, an all- DC-electric motor mode, or in a dual mode when the water flow rate varies so widely that neither the hydraulic motor mode nor the DC electric motor mode can cover the full range by itself. The system will automatically operate in the dual mode when the five-conductor cable 8 is plugged into both the DC motor driver 42 and the hydraulic valve driver 100 and the flow of water is such that the electric motor driven pump cannot supply the needed quantity of foamant concentrate to maintain the desired percentage mixture. Thus, with the five-conductor cable 8 in place, if the flow rate of the water stream is above that which can be accommodated by the DC motor when operating at its 100% duty cycle in driving the foam pump 62, the hydraulic valve driver 100 and the servo valve 102 will drive the hydraulic motor 112 and the pump 118 at a rate which will insure that the percentage concentration of liquid chemical foamant concentrate in the water stream will match a predetermined value established by the display controller 26. However, when operating in the dual mode, if the water flow is made to decrease below a threshold than what can be accommodated by the hydraulic motor driven pump with the DC drive present, the system automatically reconfigures itself to stop the hydraulic motor and run the DC electric motor between that threshold and its lower limit. The threshold itself may lie in the range of from 0.1 gal/min to 10 gal/min with ¾ gal/min being preferred As will be explained in greater detail when the implementation of the hydraulic valve driver circuit 100 is discussed, it includes a microprocessor in it, but the DC motor driver 42 does not. Thus, to apprise the display controller when the DC motor configuration is present, it looks to see if there is a 12 volt DC voltage on one of the lines in cable 6. It will be recalled from the aforereferenced Arvidson et al. patent that power for the display/controller 26 came to it from the DC motor driver 42. As soon as the system is powered up, the hydraulic valve driver 100 is effectively told whether or not a DC motor driver 42 is attached by virtue of its having received the 13.8 volt DC voltage from the DC motor driver module.

The display controller 26 automatically interrogates to determine the configuration it is working with. More particularly, the display controller 26 sends out an 800 Hz interrogate signal on the PWM line in the cable 6 and if the display controller gets a 200 Hz response back from the microprocessor in the hydraulic valve driver 100, then it knows that the hydraulic valve driver is in the circuit. Likewise, if the five conductor cable 8 is in place as shown in FIG. 1, the microprocessor in the hydraulic valve driver 100 will advise the display controller 26 that it has a DC motor included in the system configuration by returning a 100 Hz signal.

Figure 2:
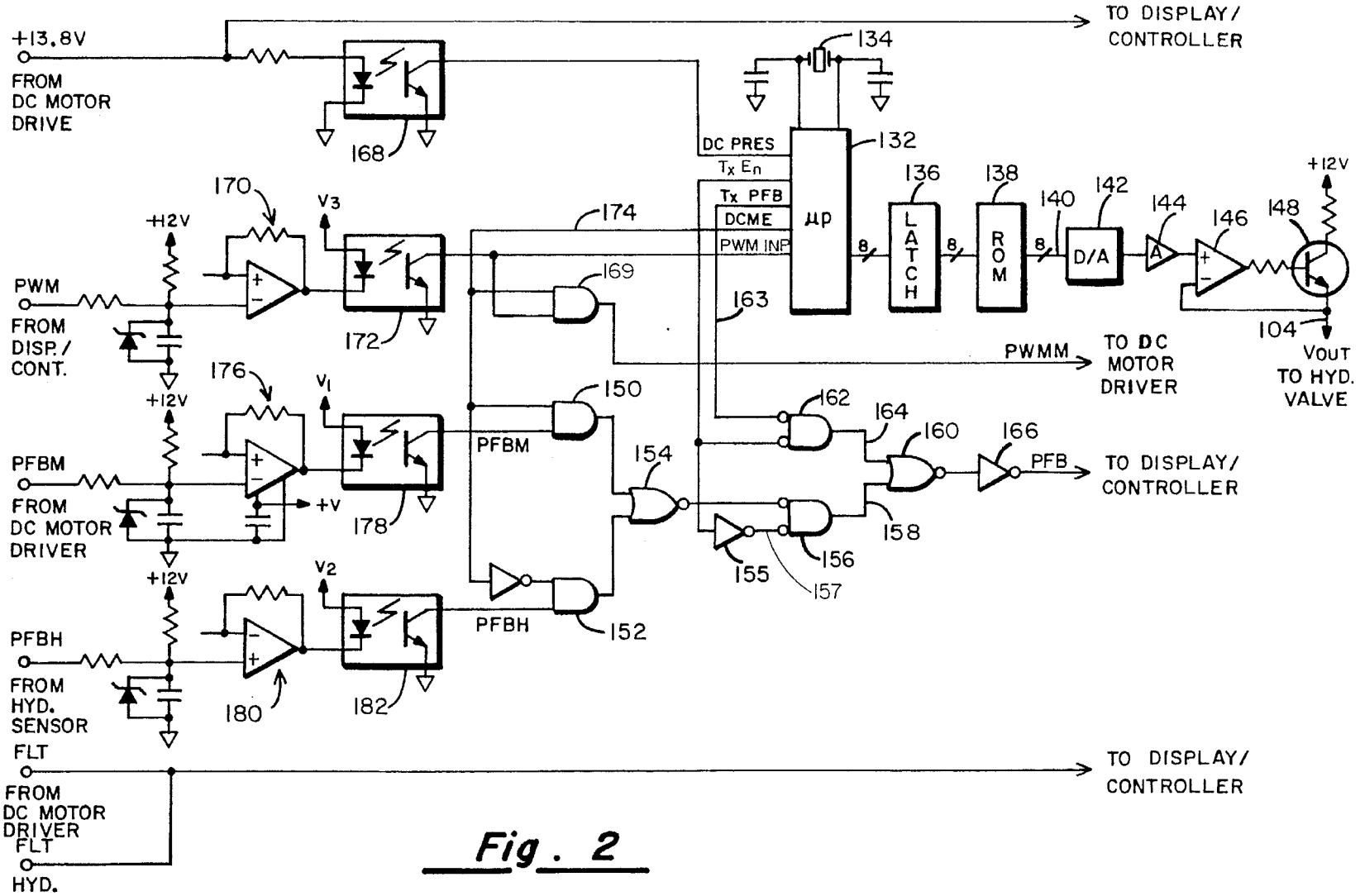
FIG. 2 is a schematic electrical diagram of the hydraulic valve driver circuit of FIG. 1.

Referring to FIG. 2, a microprocessor 132 forms a part of the hydraulic valve driver 100. It may, for example, be identical to the microprocessor used in the display controller 26—a N80C51FA 8-bit microcontroller. It is made to run at a 11.059 megahertz rate by the external crystal 134. An address latch 136 is connected to the address lines of port 1 and the output lines of the latch are, in turn, connected to the address inputs of a ROM memory chip 138. The data output lines 140 connect to the inputs of a D-to-A converter 142 which is capable of outputting a voltage in the range of from 0 to 2.56 volts depending upon the digital data word applied to its input terminals via bus 140. An amplifier stage 144 provides a gain of 2 and its output is connected to the input of a buffer circuit 146. The amplifier and buffer are preferably a single LM258 chip, but limitation to that particular circuit is not intended. The output from the buffer 146 is resistor coupled to a NPN transistor 148 which produces a signal $V_{out}$ on line 104 going to the servo valve 102 (FIG. 1).

Because the microprocessor in the display controller 26 has only one input for receiving the pump feedback (PFB) signal indicative of pump speed or foamant concentrate flow and because there are two sources for the PFB signal (the DC motor driven pump and the hydraulic motor driven pump), a multiplexer circuit is provided which includes the AND gates 150 and 152 and a NOR gate 154. The AND gate 150 is enabled by an output from the microprocessor 132 called DCME, the acronym for DC Motor Enable. The AND gate 152 is enabled by the complement of the DCME output from the microprocessor. The PFB signal from the DC motor controller is applied over a line in the cable 8 to a receiver circuit 176 and an opto-coupler circuit 178 to the input of AND gate 150. Likewise, the PFB signal from OR gate 130 is applied via a receiver circuit 180 and an opto-coupler circuit 182 to the input of AND gate 152. The resulting signal will only pass through AND gate 152 if the DCME line 174 is low, disabling the gate 150. Thus, when the pump feedback signal (PFB) is coming from the DC motor driver 42, via cable 8, into the hydraulic valve driver 100, gate 150 is fully enabled and will output a signal to NOR gate 154. However, if the pump feedback is inputted to the hydraulic valve driver 100, via the OR gate 130 (FIG. 1), it is gate 152 that is fully enabled to provide an output to NOR gate 154. If the output of either gate 150 or 152 is high, NOR gate 154 will input a low signal to AND gate 156 and when the microprocessor 132 generates the Tx En on line 157, the inputs to the negative AND gate 156 will be simultaneously low, causing a high signal to be emitted on line 158 and applied to the NOR gate 160. In a similar fashion, when the microprocessor 132 generates a transmit PFB signal (TxPFB) on line 163 when the transmit enable signal is low, negative AND gate 162 will output a high signal on line 164 to the second input on NOR gate 160. The output from NOR gate 160 is inverted at 166 and its output is conveyed on a conductor in the cable 6 back to the display controller 26 as the PFB signal. Those having read the aforereferenced Arvidson et al. patent will recall that the PFB signal is the information needed by the microprocessor in the display controller to establish the rate at which liquid chemical foamant is being pumped from the tank 50.

When the system is operating in the dual mode such that the cable 8 is coupled between the DC motor driver 42 and the hydraulic valve driver 100, the 13.8-volt power signal from the DC motor driver circuit is applied through an optical coupler 168 to the input DC present (DCPRES) of the microprocessor 132 of FIG. 2. As already mentioned, it is this signal that ultimately advises the microprocessor in the display controller that the configuration is in the dual mode.

AND gate 169 has its enable input connected to the DCME output from the microprocessor 132 and is arranged to receive the pulse width modulated signal from the display controller, via receiver circuit 170, and an opto-coupler circuit 172. Thus, when the gate is enabled, the pulse width modulated signal is sent to the DC motor driver 42, via a line in the cable 8. If the AND gate 169 is not enabled, it means that the hydraulic motor is to be utilized and the duty cycle of the pulse width modulated signal from the display controller applied to the PWM INP input line by opto-coupler 172 is converted by the microprocessor 132 to a hexadecimal number between 00 and FF. That code is applied to the D/A converter 142 to produce a unique analog current signal corresponding to that code for driving the servo valve 102 so as to allow a proportional amount of hydraulic fluid to flow from the source, through the shut-off valve 106 and the servo valve 102, to the hydraulic motor 112.

If the PWM input (PWM INP) to the microprocessor subsequently drops to the point where the flow can only be accommodated by the DC electric motor drive, the microprocessor 132 senses that fact and produces the DCME output on line 174 to again enable AND gate 169 so that the PWM signal from the display controller is once again forwarded onto the DC motor controller 42.

Figure 3:
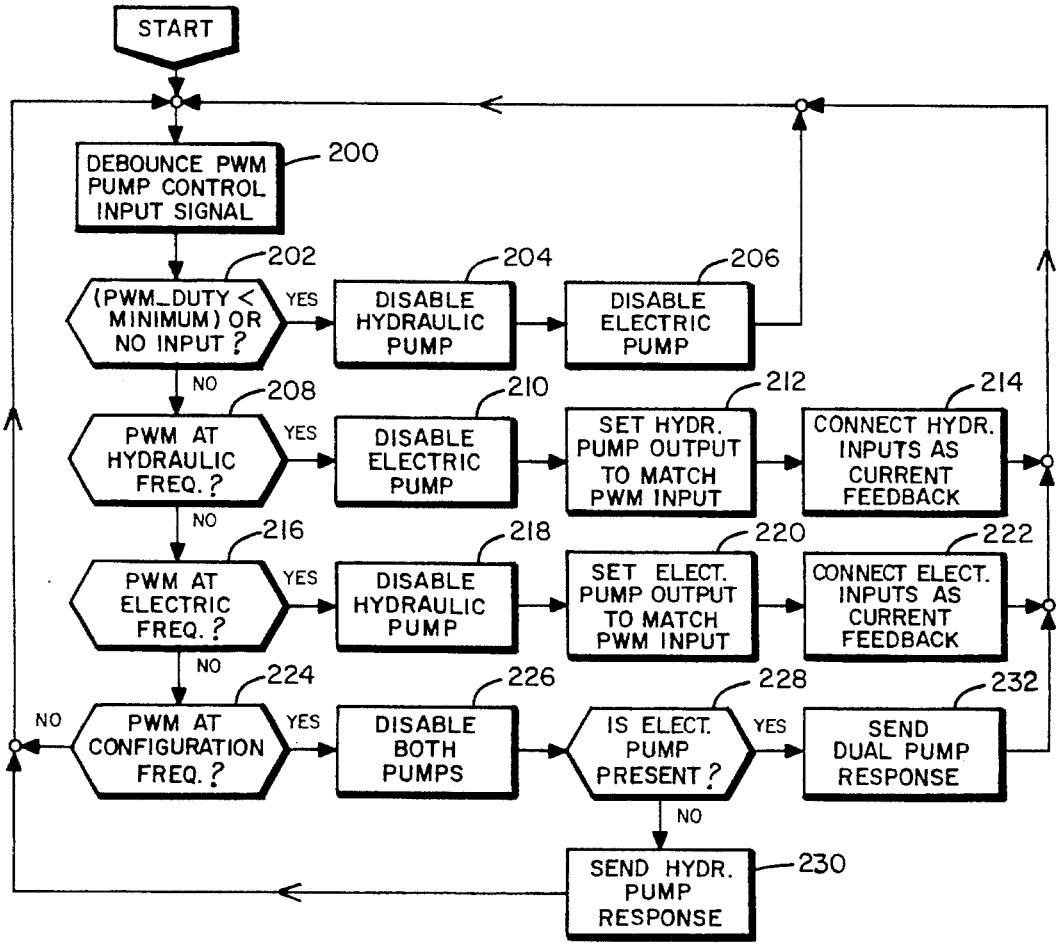
FIG. 3 comprises a software flow diagram useful in understanding the manner in which the microprocessor-based controller and the microprocessor used in the hydraulic valve driver of FIG. 1 are programmed.

Referring now to FIG. 3, there is shown a software flow diagram of the program executed by the microprocessor 132 in the hydraulic valve driver 100. At startup, the microprocessor in the display controller 26 transmits a pulse width modulated pump control input signal over bus 6 to the microprocessor 132 which debounces that signal in a conventional fashion as represented by block 200 in FIG. 3. At decision block 202, a test is made to determine whether the duty cycle of the pulse width modulated control signal is below a predetermined minimum or if no input is currently present. If that test is affirmative, both the hydraulic motor 112 and the DC motor 80 (FIG. 1) are disabled (blocks 204 and 206) and control returns to the starting point.

Assuming that the PWM signal from the display controller is present, a test is made at decision block 208 to determine whether the PWM signal has a frequency indicative of hydraulic pump operation, e.g., 200 Hz, the microprocessor 132 disables the DC motor driver (block 210) and causes the PWM signal from the display controller to be applied to the digital-to-analog converter 142, resulting in the production of an analog current signal on line 104 (FIG. 2) proportional to the duty cycle of the PWM signal and which is applied to the hydraulic servo valve 102. This operation is represented by block 212 in FIG. 3. Also, the microprocessor 132 produces an output, via the multiplexer circuitry to enable AND gate 152 of the multiplexer whereby the pump feedback signal to the display controller 26 will originate at the output of OR circuit 130 of the hydraulic valve driver (FIG. 1) with control returning to the starting point. This operation is represented by block 214 in FIG. 3.

Had the test at decision block 208 been negative, a test would then be made at decision block 216 to determine whether the frequency of the pulse width modulated signal from the display controller was at a value indicative of electric motor operation, e.g., a 100 Hz signal. Assuming that the 100 Hz signal is present and the system is to be made to operate in the electric motor driven pump mode, the microprocessor 132 outputs a signal for disabling the hydraulic pump (block 218). The electric motor is driven in the manner described in the aforereferenced Arvidson et al. patent. The electric motor pump feedback signal thus indicates to the display controller that the electric motor driven pump is operating at a speed corresponding to the appropriate duty cycle provided by the microprocessor in the display controller. See block 220. The multiplexer is also appropriately enabled so that the float signal and the pump feedback signal from the electric motor driver (PFBM) are transmitted via the hydraulic valve driver module to the microprocessor in the display controller (block 222).

If the PWM signal is neither at the hydraulic frequency (200 Hz) or the electric frequency (100 Hz), a test is made at decision block 224 to determine whether the frequency of the PWM signal corresponds to an interrogation signal, e.g., 800 Hz. In response to the presence of the interrogation frequency, both the hydraulic pump and the electric motor driven pump are disabled (block 226) and then a further test is made at decision 228 to determine whether an electric motor driven pump is present in the system. It will be recalled that this is determined by sensing whether a DC voltage of about 12 volts is present on the power line in the cable 6 (FIG. 1). If no electric motor driven pump is present in the system, a 200 Hz signal is returned to the display controller module 26 (block 230), apprising the display controller that the system it is dealing with includes only a hydraulic motor. Had the test at decision block 228 indicated that an electric motor driven pump was present in the system, the microprocessor 132 would have transmitted a signal over the PFB line in the cable 6 back to the display controller effectively informing it that the system is in the dual hydraulic/electric motor configuration (block 232).

It is believed that one skilled in the art having the flow chart of FIG. 3 and knowledgeable of the desired mode of operation of the system reflected thereby would be in a position to write the source code for the microprocessor 132 such that it is unnecessary to include herein the source code listings for that software.

It can be seen, then, that the present invention provides a system for introducing a liquid chemical foamant into a water stream used in fire fighting that is capable of maintaining a desired concentration of the chemical in the water stream, even though the flow rate of the water stream may vary over an extremely wide range from, say, 600 gallons per minute down to 2 gallons per minute. If the flow rate of the water shifts from a low range at which the electric motor driven pump is capable of maintaining the desired foam concentration to a rate in a higher range, the hydraulic motor drive is automatically switched into operation, thereby allowing greater measured quantities of the foam concentrate to be introduced into the water stream than can be accomplished using only the DC motor drive. Similarly, when the system is operating in the dual mode and the water stream flow rate is made to drop below a predetermined threshold that can only be satisfied using the hydraulic motor driven pump, the hydraulic valve drive circuit switches the hydraulic motor out and permits the system to operate in the electric motor driven configuration. As is explained in the aforereferenced Arvidson et al. patent, the electric motor drive permits precise control over the introduction of liquid chemical foamant into a water stream where the flow rate of that water stream is such that foamant added is in the range of from a few ounces up to about 1.15 gpm.

This invention has been described herein in considerable detail in order to comply with the Patent Statutes and to provide those skilled in the art with the information needed to apply the novel principles and to construct and use such specialized components as are required. However, it is to be understood that the invention can be carried out by specifically different equipment and devices, and that various modifications, both as to the equipment details and operating procedures, can be accomplished without departing from the scope of the invention itself.

What is claimed is:

1. A fire extinguishing system of the type including means for injecting metered quantities of a liquid chemical foamant into a hose assembly conveying a water stream of variable flow rate so as to maintain a desired concentration of said chemical foamant in said water stream exiting said hose assembly over a wide range of water flow rates, said system comprising, in combination:

(a) tank means for holding a quantity of said liquid chemical foamant;

(b) first and second foam pumps, each having an inlet port and an outlet port, said inlet ports being coupled to said tank means and said outlet ports being coupled to said hose assembly;

(c) an electric motor for driving said first foam pump;

(d) a hydraulic motor for driving said second foam pump;

(e) a sensor operatively coupled to said hose assembly to sense a characteristic of the water stream flowing through said hose assembly and produce an electrical signal proportional to the sensed characteristic; and (f) electronic control means responsive to said electrical signal for driving said electric motor when a volume rate of flow of said chemical foamant to be added to said water stream to maintain said desired concentration is below a first threshold and for driving said hydraulic motor when said volume rate of flow of said chemical foamant to be added to said water stream to maintain said desired concentration is above said first threshold.

2. The fire extinguishing system as in claim 1 wherein said threshold lies in the range of 0.1 gallons per minute to 10 gallons per minute.

3. The fire extinguishing system as in claim 2 wherein said threshold is about ¾ gallons per minute.

4. The fire extinguishing system as in claim 1 wherein said first and second pumps are each positive displacement piston pumps.

5. The fire extinguishing system as in claim 1 wherein said first pump is a positive displacement pump and said second pump is a non-positive displacement pump.

6. The fire extinguishing system as in claim 1 in which said characteristic is a volume rate of flow of water through said hose assembly and said sensor includes: means for sensing the volume rate of flow through said hose assembly; and said electronic control means includes:

pump speed sensing means operatively coupled to at least one of said first and second foam pumps for producing an output signal related to a speed at which said one of said first and second foam pumps is being driven, computing means coupled to receive said electrical signal and said output signal said one of said first and second foam pumps should be driven to maintain said desired concentration of said chemical foamant in said water stream exiting said hose assembly, said computing means producing a pulse width modulated electrical control signal whose frequency is indicative of which one of said electrical and hydraulic motors is to be driven and whose duty cycle is indicative of the speed at which the driven one of said electric and hydraulic motors is to operate, and pump driver means coupled to receive said electrical control signal from said computing means for controlling the speed that the one of said electric and hydraulic motors driving said one pump is to be driven.

7. A fire extinguishing system of the type including means for injecting metered quantities of a liquid chemical foamant into a hose assembly conveying a water stream so as to maintain a desired concentration of said chemical foamant in said water stream exiting said hose assembly over a wide range of water flow rates through the hose assembly, said system comprising in combination:

(a) tank means for holding a quantity of said liquid chemical foamant;

(b) at least one foam pump having an inlet port coupled to said tank and an outlet port coupled to said hose assembly;

(c) a hydraulic motor connected in driving relation to said one foam pump;

(d) a hydraulic servo valve coupled in series circuit relation with said hydraulic motor and a source of pressurized hydraulic fluid;

(e) a sensor operatively coupled to said hose assembly to sense a characteristic of the water stream flowing through said hose assembly and producing a first electrical signal indicative thereof; and (f) control means responsive to said first electrical signal and a volume rate of liquid chemical foamant flow through said outlet port for producing a second electrical signal for modulating a speed at which said hydraulic motor is driving said foam pump, such that a desired quantity of the liquid chemical foamant in the water stream exiting said hose assembly maintains said desired concentration.

8. The fire extinguishing system as in claim 7 wherein said control means comprises:

(a) a first microprocessor having a memory means for storing a program of instructions and operands, said first microprocessor adapted to receive said first electrical signal for computing a pump speed for delivering said desired quantity of the liquid chemical foamant into said water stream, said microprocessor generating said second electrical signal which comprises a pulse width modulated signal train of a computed duty cycle that is related to said computed pump speed;

(b) a second microprocessor adapted to receive said pulse width modulated signal train from said first microprocessor for converting said duty cycle to a digital quantity;

(c) digital-to-analog conversion means coupled to said second microprocessor for converting said digital quantity to an analog current proportional in amplitude to said computed pump speed; and (d) means for applying said analog current to said hydraulic servo valve.

9. The fire extinguishing system as in claim 8 wherein said control means further includes means for transmitting one of pump speed information and pump output flow information from said second microprocessor to said first microprocessor.

10. The fire extinguishing system as in claim 8 and further including:

(a) a second foam pump having an inlet coupled to said tank means and an outlet coupled to said hose assembly;

(b) a direct current motor for driving said second foam pump; and (c) direct current motor driver means coupled to said second microprocessor and adapted to receive said pulse width modulated signal train for driving said direct current motor at the speed determined by said computed duty cycle of said pulse width modulated signal train.

11. The fire extinguishing system as in claim 10 wherein said control means includes means four enabling only said direct current motor driver means when said volume rate of flow of said liquid chemical foamant needed to maintain said desired concentration is less than a predetermined threshold and for enabling the driving of only said hydraulic motor when said volume rate of flow of said liquid chemical foamant is above said predetermined threshold.

12. The fire extinguishing system as in claim 11 wherein said threshold is in the range of from 0.3 gal./min. to about 10 gal./min.

13. The fire extinguishing system as in claim 12, wherein said threshold is about ¾ gal./min.

* * * * *

UNITED STATES PATENT AND TRADEMARK OFFICE

CERTIFICATE OF CORRECTION

PATENT NO. : 5,494,112

DATED : February 27, 1996

INVENTOR(S) : Lawrence C. Arvidson, et al.

It is certified that error appears in the above-indentified patent and that said Letters Patent is hereby corrected as shown below:

In column 9, claim 6, line 50, please insert -- related to the pump speed for determining the speed at which -- after the word "signal". (2nd occurrence)

In column 11, claim 11, line 2, please delete the word "four" and insert -- for -- after the word "means".

Signed and Sealed this

Fourth Day of June, 1996

Bruce Lehman

*Attest:*

BRUCE LEHMAN

*Attesting Officer*

*Commissioner of Patents and Trademarks*